United States Patent [19]

Bocker et al.

[11] Patent Number: 4,603,398

[45] Date of Patent: Jul. 29, 1986

[54] MATRIX-MATRIX MULTIPLICATION USING AN ELECTROOPTICAL SYSTOLIC/ENGAGEMENT ARRAY PROCESSING ARCHITECTURE

[75] Inventors: Richard P. Bocker, San Diego, Calif.; Henry J. Caulfield, Nagog Woods, Mass.; Keith Bromley, San Diego, Calif.

[73] Assignee: The United States of America as represented by the Secretary of the Navy, Washington, D.C.

[21] Appl. No.: 581,168

[22] Filed: Feb. 17, 1984

[51] Int. Cl.[4] ..... G06G 9/00; G06G 7/16

[52] U.S. Cl. ..... 364/845; 364/606; 364/841; 364/837

[58] Field of Search ..... 364/602, 606, 713, 715, 364/754, 807, 819, 822, 841, 845, 827, 837; 350/96.11, 96.14, 96.16, 162.12, 353, 355

[56] References Cited

U.S. PATENT DOCUMENTS

| | | | |
|---|---|---|---|
| 3,305,669 | 2/1967 | Fan | 364/845 X |
| 3,816,735 | 6/1974 | Bromley | 235/181 |
| 3,903,400 | 9/1975 | Nisenson | 235/152 |
| 4,009,380 | 2/1977 | Bocker et al. | 235/181 |
| 4,042,814 | 8/1977 | Taylor | 235/175 |
| 4,097,749 | 6/1978 | Gardner | 250/550 |
| 4,156,284 | 5/1979 | Engeler | 364/841 X |
| 4,365,310 | 12/1982 | Green | 364/822 |
| 4,544,229 | 10/1985 | Verber | 350/96.14 |
| 4,544,230 | 10/1985 | Caulfield | 350/96.14 |
| 4,556,950 | 12/1985 | Tai et al. | 364/713 X |

OTHER PUBLICATIONS

R. Heinz et al., "Matrix Multiplication by Optical Methods", *Applied Optics,* vol. 9, No. 9, pp. 2161–2168, Sep. 1970.

D. Jablonowski et al., "Matrix Multiplication by Optical Methods: Experimental Verification", *Applied Optics,* Vol. 11, No. 1, pp 174–178, Jan. 1972.

R. Bocker, "Matrix Multiplication Using Incoherent Optical Techniques", *Applied Optics,* vol. 13, No. 7, pp. 1670–1676, Jul. 1974.

K. Bromley, "An Optical Incoherent Correlator", *Optica Acta,* vol. 21, No. 1, pp. 35–41, Jan. 1974.

M. Monahan et al., "Incoherent Electrooptical Processing with CCD's", International Optical Computing Conference Digest, pp. 25–33, Apr. 1975.

M. Monahan et al., "Incoherent Optical Correlators", *Proceedings of the IEEE,* vol. 65, pp. 121–129, Jan. 1977.

J. Goodman et al., "Fully Parallel, High-Speed Incoherent Optical Method for Performing Discrete Fourier Transforms", *Optics Letters,* vol. 2, pp. 1–3, Jan. 1978.

D. Psaltis et al., "Iterative Color-Multiplexed, Electro-Optical Processor", *Optics Letters,* vol. 4 pp. 348–350, Nov. 1979.

(List continued on next page.)

*Primary Examiner*—Gary V. Harkcom

*Attorney, Agent, or Firm*—Robert F. Beers; Thomas G. Keough

[57] ABSTRACT

A electrooptic systolic array architecture performs matrix-matrix multiplication using incoherent light. The incoherent light is collimated and passed through a polarizing beamsplitter and onto a pair of optically reflecting light valves. Each of the valves has a number of cells which are continuously being updated in a clocked sequence to vary their reflectivity in accordance with the data sequence. As the collimated incoherent light source is pulsed the reflectivity of the cells of the two light valves is reflected back through the polarizing beamsplitter and onto a photodetector array. The photodetector array senses the multiplied signals from the two valves and provides a representative output in the same time frame as the pulsed collimated light source. Another polarizing beamsplitter can be disposed to receive the multiplied signals from the first two valves and combined or multiplied with the input from yet another light valve which is, in turn, received by an additional photodetector array. This sequence can be repeated depending on the number of stages desired. A feedback capability is also provided for when iterative processing is desired.

18 Claims, 11 Drawing Figures

OTHER PUBLICATIONS

B. Kumar et al., "Eigenvector Determination by Iterative Optical Methods", *Applied Optics,* vol. 20, No. 21, pp. 3707–3710, Nov. 1981.

M. Carlotto et al., "Microprocessor–Based Fiber–Optic Iterative Optical Processor", *Applied Optics,* vol. 21, No. 1, pp. 147–152, Jan. 1982.

H. Kung, "Special–Purpose Devices For Signal and Image Processing: An Opportunity in Very Large Scale Integration (VLSI), *SPIE,* vol. 241, pp. 76–84, 1980.

H. Kung, "Why Systolic Architectures?", *Computer,* vol. 15, pp. 37–46, Jan. 1982.

J. Symanski, "A Systolic Array Processor Implementation", *SPIE,* vol. 298, pp. 1–6, Aug. 1981.

J. Symanski, "Progress on a Systolic Processor Implementation", *SPIE,* vol. 341, 1982.

J. Speiser et al., "Parallel Processing Algorithms and Architectures for Real–Time Signal Processing", *SPIE,* vol. 298, 1981.

H. Caulfield et al., "Acousto–Optical Matrix–Vector Multiplication", Presentation at Annual Meeting of the Optical Society of America, Kissimmee, Florida, Oct. 1981.

G. Fowles, *Introduction to Modern Optics,* Holt, Reinhardt, and Winston, 1968, pp. 182–183.

R. Kingston et al., "Spatial Light Modulation Using Electroabsorption in a GaAs Charge–Coupled Device", *Applied Physics Letters,* vol. 41, pp. 413–415, Sep. 1982.

C. Mead et al., *Introduction to VLSI Systems,* Addison–Wesley, 1980, pp. 271–292.

MATRIX-MATRIX MULTIPLICATION USING AN ELECTROOPTICAL SYSTOLIC/ENGAGEMENT ARRAY PROCESSING ARCHITECTURE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

As greater and greater amounts of data are produced that provide indications of some measurable quantity, the processing of these vast amounts of data becomes more difficult to arrive at meaningful results. Higher frequency systems such as microwave and the like, and the optical portion of the electromagnetic spectrum can and do produce choking amounts of data for processors which were otherwise felt to be quite adequate. Matrix-matrix multiplying using an all electronic systolic array architecture was advocated by H. T. Kung, see *Introduction to VLSI Systems,* Addison-Wesley, 1980, pp. 271–292 by C. Mead and L. Conway. The electronic systolic array was limited to a two-dimensional architecture and employed silicon technology along with an all electronic implementation. Operation in the two-dimensional mode was felt to be a limitation on the mathematical operation of matrix-matrix multiplication and led to the incorporation of optical techniques.

An extensive mathematical study has been made regarding the use of optical correlation techniques involving coherent light for performing matrix-matrix and matrix-vector multiplication by R. A. Heinz, J. O. Artman, and S. H. Lee, in their article entitled "Matrix Multiplication by Optical Methods," *Applied Optics,* vol. 9, pp. 2161–2168, September 1970. The optical correlation techniques of Heinz, Artman and Lee were experimentally demonstrated for matrices of the order of 2 by D. P. Jablonowski, R. A. Heinz, and J. O. Artman, as reported in their article entitled "Matrix Multiplication by Optical Methods: Experimental Verification," *Applied Optics,* vol. 11, pp. 174–178, January 1972. The technique developed and verified was found to have one limiting feature in that as the matrix order increases, the number of unwanted circular distributions of light appearing in the output plane of the processor rapidly escalates thus reducing the light available at those positions corresponding to product matrix element information. As follow-ons to this technique, there have been a number of other approaches investigated using incoherent light for performing matrix-vector multiplication. One which comes to mind is the preliminary study in this area which describe the computation of one-dimensional discrete Fourier transforms as discussed by Richard P. Bocker in his article entitled "Matrix Multiplication Using Incoherent Optical Techniques," *Applied Optics,* vol. 13, pp. 1670–1676, July 1974. Since, cosine and Walsh-Hadamard transforms, as well as a variety of linear filtering operations were discussed by Richard P. Bocker in his Ph.D. dissertation, "Optical Matrix-Vector Multiplication and Two-Channel Processing with Photodichroic Crystals," which is available at the University of Arizona, Tuscon, 1975 (Univ. Microfilms 75-26 925).

The technical feasibility of Bocker's particular approaches were demonstrated for matrices of order 32 using an optical device earlier developed by Keith Bromley and is fully explained in his article "An Optical Incoherent Correlator, " *Optica Acta,* vol. 21, pp. 35–41, January 1974. Mr. Bromley made the demonstrations for performing correlation and convolution operations with incoherent light. In the original version of an optical correlator, a single light emitting diode, photographic film transparency, mechanical scanning mirror, and a vidicon detector were employed. More recently, Michael A. Monohan, Richard P. Bocker, Keith Bromley and Anthony Louie discovered that the scanning mirror and vidicon detector could be replaced by a solid-state area-array coupled device thus greatly reducing the size of the processor, see their article entitled "Incoherent Electrooptical Processing with CCD's," *International Optical Computing Conference Digest* (IEEE Catalog 75 CH0941-5C), April 1975 and an article by Monahan, Bromley and Bocker entitled "Incoherent Optical Correlators", *Proceedings of the IEEE,* vol. 65, pp. 121–129, January 1977. It was found that matrix-vector multiplying operations involving matrices of order 128 can be and are presently performed using this approach.

A second technique for computing matrix-vector products using incoherent light involves the use of a linear array of light emitting diodes, an optical transparency, and a linear array of photodetectors. The groundwork and development for this technique were made by J. W. Goodman, A. R. Dias, and L. M. Woody, in their article entitled "Fully Parallel, High-Speed Incoherent Optical Method for Performing Discrete Fourier Transforms," in *Optics Letters,* vol. 2, pp. 1–3, January 1978. The architecture of the publication has the advantage that the data vector information may be entered in parallel, thus allowing for higher throughput rates. The feasibility of this approach has been demonstrated for matrices of order 10. Combining this architecture with a one-dimensional adder in a feedback loop gives rise to an iterative electrooptical processor, see the article by D. Psaltis, D. Casasent, M. Carlotto, entitled "Iterative Color-Multiplexed, Electro-Optical Processor," *Optics Letters,* vol. 4, pp. 348–350, November 1979. With this capability it is possible to perform other higher-level matrix operations such as the solution of simultaneous algebraic equations, least squares approximate solution of linear systems, matrix inversions, and eigensystem determinations just to mention a few. These solutions have, in fact, been demonstrated by B. V. K. Vijaya Kumar and D. Casasent, in "Eigenvector Determination by Iterative Optical Methods," *Applied Optics,* vol. 20, pp. 3707–3710, November 1981 and by M. Carlotto and D. Casasent in "Microprocessor-Based Fiber-Optic Iterative Optical Processor," *Applied Optics,* vol. 21, pp. 147–152, January 1982.

Even more recently, much attention has been focused on implementing parallel processing architectures for performing a variety of matrix operations using exclusively electronic components. In addition to the work by H. T. Kung, identified above he has shown further efforts in this field in his two articles entitled "Special-Purpose Devices for Signal and Image Processing: An Opportunity in Very Large Scale Integration (VLSI)," *SPIE,* vol. 241, pp. 76–84, 1980 and "Why Systolic Architectures?," *Computer,* vol. 15, pp. 37–46, January 1982. Combining VLSI/VHSIC technology with systolic array processing techniques should give rise to increased signal-processing capabilities by at least a factor of 100, see J. J. Symanski's article entitled "A Systolic Array Processor Implementation," *SPIE,* vol. 298, 1981. Already a two-dimensional systolic array test bed has been designed and fabricated for validating many of the proposed architectures and algorithms envisioned, note J. J. Symanski's article "Progress on a Systolic Processor Implementation," *SPIE,* vol. 341, 1982. In addition a similar all electronics parallel approach has been proposed by J. M. Speiser and H. J. Whitehouse in their presentation entitled "Parallel Processing Algorithms and Architectures for Real-Time Signal Processing," *SPIE,* vol. 298, 1981 using an engagement array architecture.

As it turns out, the proposed new systolic/engagement type of architectures are not restricted to solely all electronic implementations. For example, an acoustooptical approach using incoherent light for performing matrix-vector multiplication employing the systolic/engagement array architecture recently has been described by H. J. Caulfield and W. T. Rhodes in their presentation entitled "Acousto-Optic Matrix-Vector Multiplication," that was presented at the Annual Meeting of the Optical Society of America, Kissimmee, FL, October 1981. Their acoustic optic processor uses a linear array of light emitting diodes for inputting the matrix information, and acousto-optic travelling wave modulator for inputting the vector information, and a linear array charge-coupled device for computing the desired output vector information. Their approach had the advantage that the input vector and matrix information may be entered in real-time.

Thus there is a continuing need in the state-of-the-art for a device for performing the mathematical operation of matrix-matrix multiplication using electrooptical technology to have the capability for handling increased amounts of data in real time.

SUMMARY OF THE INVENTION

The present invention is directed to providing an apparatus and method for performing the mathematical operation of matrix-matrix multiplication using electro-optical technology. A collimated light source projects collimated light through a polarizing beam splitter onto a first optically reflecting light valve. Light is reflected from the first valve back through the beam splitter and onto a second optically reflecting light valve. The valves each contain a number of cells each of which represent a predetermined mathematicl quantity. The predetermined mathematical quantities are selectively displaceable in accordance with a clock sequence and a photodetector array is disposed to receive reflected portions of the incoherent light which are reflected from the valves, back through the polarizing beamsplitter and onto the detector array. The information of matrix A of the first valve and the information of matrix B of the second valve can thereby be multiplied on a sequential basis and received as matrix-matrix multiplied data AB at the surface of the photodetector array. Serially imposing another polarizing beamsplitter to receive the AB data along with a C data input from another like valve will enable the multiplication of ABC data. Further modification evisions the inclusion of a feedback loop from the photodetector array combined with the information of the updated data A on the first light valve. Transmissive light valves arranged in line also can accomplish the above.

A prime object of the invention is to provide an electrooptical systolic array architecture for performing matrix-matrix multiplication using incoherent light.

Still another object is to provide an electrooptic systolic array having the capability of providing cascaded matrix-matrix multiplications.

Yet another object of the invention is to provide an electrooptical signal processor including at least two dynamic light valves operating in a reflection mode along with a two-dimensional photodetector array and a single incoherent light source.

Another object is to provide an electrooptical signal processor including at least two dynamic light valves operating in the transmission mode.

Still another object of the invention is to provide a signal processing device employing at least one polarizing beamsplitter along with a pair of dynamic light valves and a two-dimensional photodetector array to perform matrix-matrix multiplication.

Still another object is to provide an apparatus for performing a mathematical operation of matrix-matrix multiplication using linearly polarized light reflected through a polarizing beamsplitter and a pair of quarter-wave plates prior to being reflected back through the polarizing beamsplitter and onto the photodetector array.

Yet another object of the invention is to provide an improved signal processing technique relying upon electrooptical advances to improve the data rate capability, reduce distortion and provide a real-time processing of increased amounts of data.

These and other objects of the invention will become more readily apparent from the ensuing description and claims when taken with the appended drawings.

DESCRIPTION OF THE PREFERRED EMBODIMENTS

Figure 1:
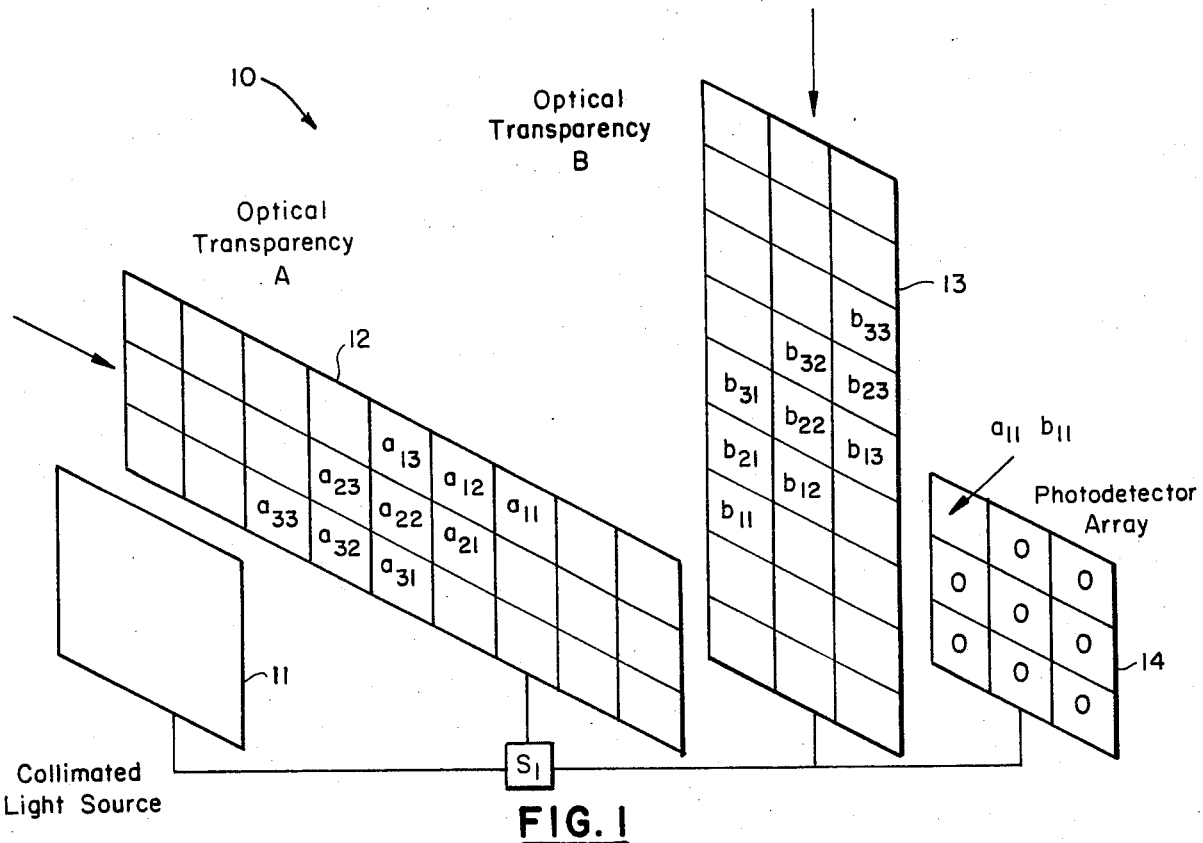
FIG. 1 is a representation of an optical systolic matrix-matrix multiplier using sliding optical transparencies in the initial state.

Referring to the drawings and in particular to FIG. 1, the essence of this inventive concept can be more readily gleaned from a preliminary examination of the operation of a sliding film processor 10. To illustrate the concept of a matrix-matrix multiplication using an electrooptical engagement array architecture, consider the case when the matrices involved have real-positive elements only and are of order 3. The matrices are expressed as:

$$\begin{bmatrix} a_{11} & a_{12} & a_{13} \\ a_{21} & a_{22} & a_{23} \\ a_{31} & a_{32} & a_{33} \end{bmatrix} \begin{bmatrix} b_{11} & b_{12} & b_{13} \\ b_{21} & b_{22} & b_{23} \\ b_{31} & b_{32} & b_{33} \end{bmatrix} = \begin{bmatrix} c_{11} & c_{12} & c_{13} \\ c_{21} & c_{22} & c_{23} \\ c_{31} & c_{32} & c_{33} \end{bmatrix}$$

The matrices can be equivalently expressed as:

$$AB=C$$

where A and B are known input matrices and C is the desired output matrix. Each of the elements of the matrix C is obtained by the equation:

$$C_{ik} = \sum_{j=1}^{3} a_{ij}b_{jk} \; i,k = 1,2,3$$

While the matrices are of the order 3 it is understood that the techniques to be discussed equally apply to matrices of any order. Order 3 matrices were chosen merely to easily illustrate the concepts involved.

Referring once again to FIG. 1, sliding film processor 10 is provided with a two-dimensional array of photodetectors 11 initially containing a 0 charge at each detector site. Two optical film transparencies 12 and 13 are encoded as shown with the matrix A and matrix B information as set out in the first equation. Each transparency is capable of sliding in front of the photodetector array as shown and an incoherent light source provides a spatially uniform collimated light beam source 14 which is made up of a time sequence of equal intensity pulses. An electronic switch S, provides actuation for the source, shifting of the transparancies (via suitable mechanical means such as a ratchet and pawl mechanism) and the actuation of the array. The light propagation is from left to right in the figure.

As noted in the figure, both of the optical transparencies 12 and 13 are each partitioned into an array of rectangularly shaped resolution cells some containing the matrix A and matrix B information with the remaining cells being optically opaque. The arrangement shown in the drawings can be verbally described as a pattern of progressively staggered rows and aligned columns of encoded cells. Those cells containing matrix information have an intensity transmittance proportional to the magnitude of the corresponding matrix element located at that cell. At any one instant in time, only a $3\times3$ array of resolution cells in each transparency is illuminated by a single light pulse of short time duration from the collimated light source. The resulting spatially modulating light beam impinges upon the photodetector array where the photoelectric charge is generated and accumulated.

Figure 2:
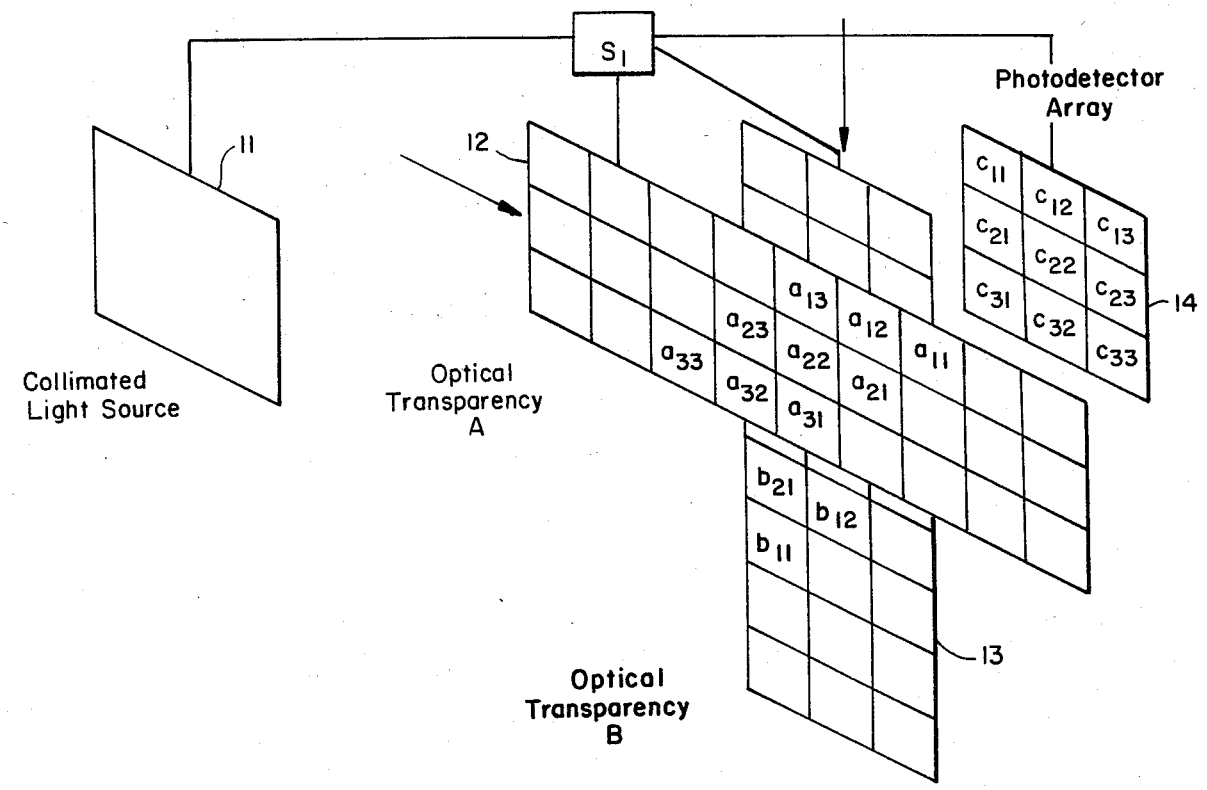
FIG. 2 shows the optical systolic matrix-matrix multiplier that uses the sliding optical transparencies in a later state of operation.

Initially the optical transparencies are so positioned that the first light pulse passing through the system passes through those $3\times3$ arrays containing only the small $a_{11}$ and $b_{11}$ element information, respectively. The result is that only the photodetector in the upper left-hand corner of the photodetector array receives light, see FIG. 1. The amount of photoelectric charge generated at that particular detector is proportional to the product of $a_{11}$ and $b_{11}$. Next, optical transparency A is shifted horizontally to the right one resolution width and transparency D is shifted vertically downward one resolution cell height. At this point, the light source is actuated to generate a second pulse of light identical to the first. Now, the upper-left three photodetectors in the array each generate quantities of photoelectric charge proportional to the product of the transmittances of those resolution cells directly in front of each of the detectors. This process continues in this manner until the optical transparencies have physically translated by the detector array as shown in FIG. 2. Upon closer examination it is noted that each photodetector element site now has a quantity of photoelectric charge which has accumulated that is proportional to each of the matrix elements comprising the desired matrix C. This then represents the simple version of the engagement array architecture for performing matrix-matrix multiplication using two optical film transparencies which physically translate across the face of a fixed photodetector array. Obviously, this matrix-matrix multiplication calls for the synchronized pulsing of the collimated light source 14 and the horizontal and vertical translation of the two optical transparencies 12 and 13 and the consequent synchronized extraction of the multiplied photoelectric charge accumulated in photodetector array 11.

The foregoing discussion of the sliding film processor illustrates the basic concept of using an optical engagement array approach for performing the matrix-matrix multiplying operation; however, it is apparent that the architecture lacks the capability of updating or changing the information of the input matrices A and B in a real-time manner. This limitation is principally due to the fact that most optical transparencies are made on photographic film, a nonreal-time record and playback optical medium. Of course, one way around this difficulty is through the use of light valves whose optical properties are changeable in real-time by electronic means. That is, if the translating optical transparencies are replaced by stationary light valves whose transmission characteristics can be changed and updated, the matrix-matrix multiplication is performed without the need for physically translating components as was the case in the optical transparencies of FIGS. 1 and 2.

Figure 3:
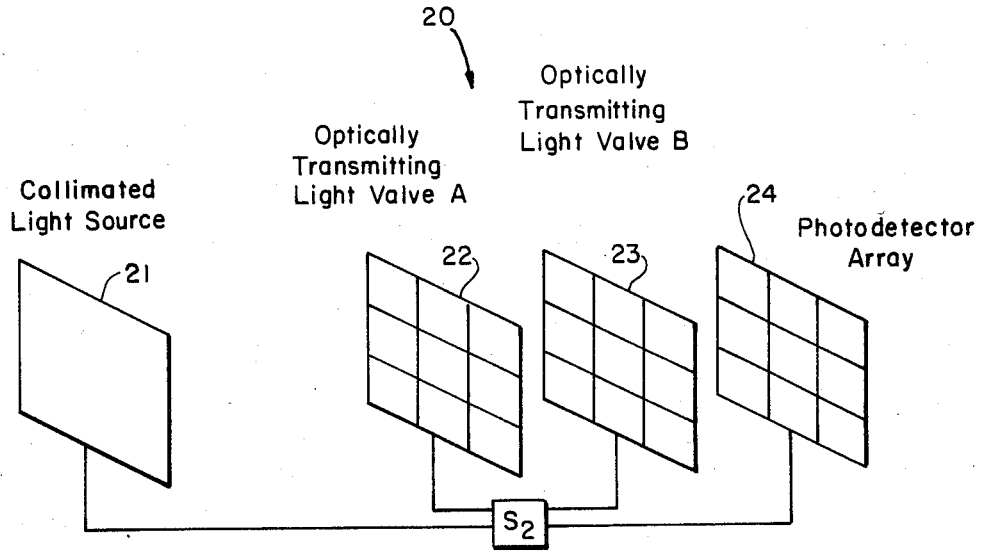
FIG. 3 represents the key components of a solid state electrooptical array matrix-matrix multiplier using transmission light valves.

FIG. 3 depicts the basic components required for a matrix-matrix multiplication architecture 20 using a pair of optically transmitting light valves. In this embodiment the components include an incoherent pulsed collimated light source 21 having essentially the same properties as outlined above. A pair of optical light valves 22 and 23 operating in the transmission mode present matrix A and matrix B information, respectively. A two-dimensional array of photodetectors 24 is appropriately located in an aligned relationship and has essentially the same properties as before to provide a similar function. An electronic switch $S_2$ couples actuation pulses for the source, valves and arrays.

In this embodiment collimating and imaging optics may be required but are not shown here to avoid belaboring the obvious. The use of optical lens elements would certainly have to be employed when diffraction effects could not be ignored.

Figure 4:
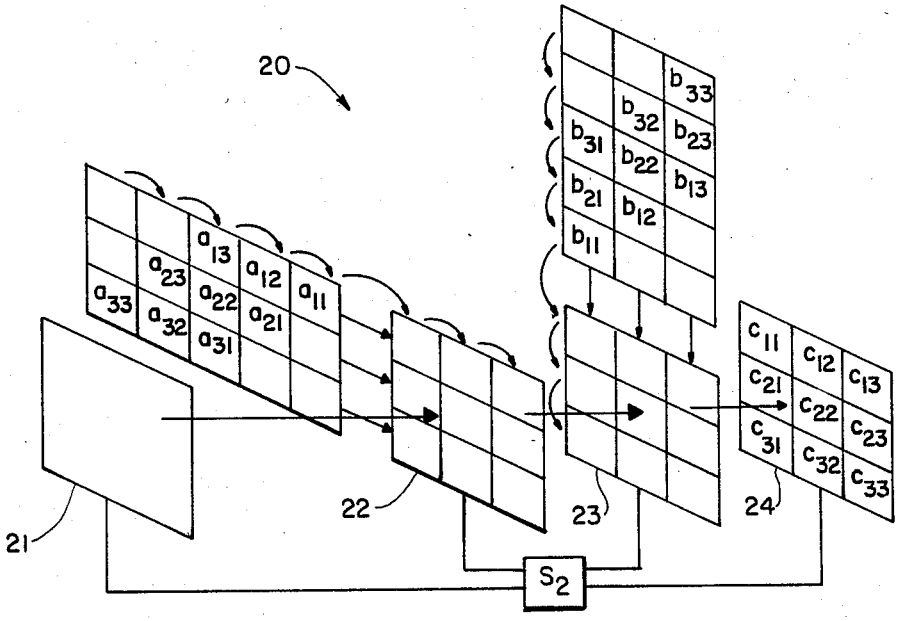
FIG. 4 shows data transfer within the electrooptical engagement array processor using transmission light valves.

The matrix A and the matrix B informations are clocked into their respective light valves by $S_2$ as shown in FIG. 4. The transferring of the matrix data within the staggered light valves using this architecture is analogous in all respects to the physical translating of the optical transparencies as described with respect to the embodiment of FIGS. 1 and 2. Again, the desired matrix C information is generated within the photodetector array where it may be clocked out in synchronization with the pulsing of the collimated light source or stored and clocked at a later time as desired.

Figure 5:
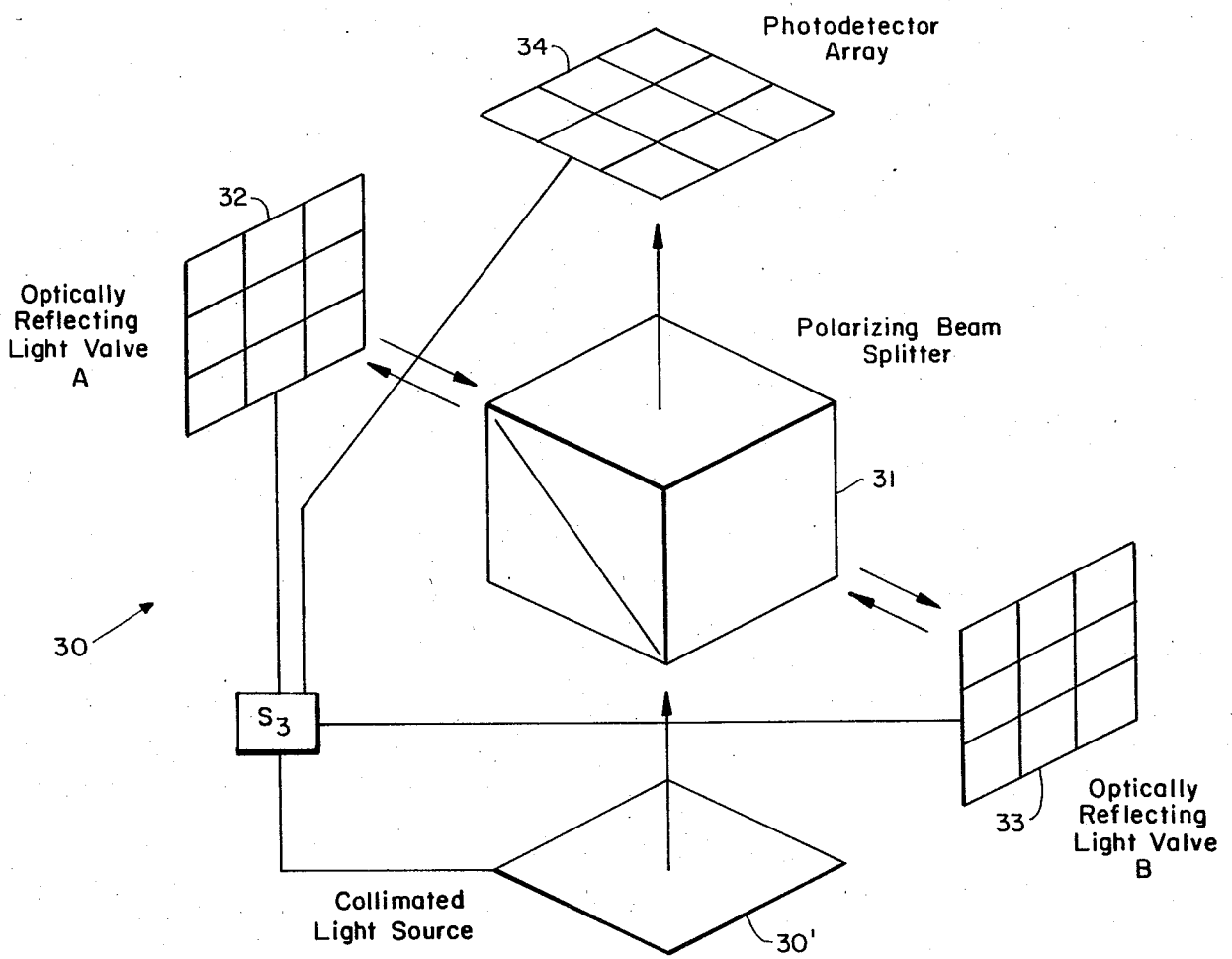
FIG. 5 depicts the key components of a solid-state optical systolic array matrix-matrix multiplier fabricated in accordance with the teachings of this inventive concept.

A third embodiment of the inventive concept shows another matrix-matrix architecture 30 as illustrated in FIG. 5. An incoherent pulsed collimated light source 30' projects light into a polarizing beamsplitter 31 of the Glan prism variety. Polarized incoherent light is reflected to a light valve 32 back through the prism and onto a light valve 33. Since the light valves operate in the reflective mode, portions of the incoherent polarized light are reflected back through the prism. The optical properties first are changed by light valve 32 and then by light valve 33. The twice changed beam is once again directed to the prism and reflected to a photodetector array 34 which is substantially the same as that referred to above. Suitable switching in a desired sequence is provided by switch $S_3$. Again, collimating and imaging optics may be required but these are not shown to avoid belaboring the obvious and a consequent cluttering of the inventive concept.

Figure 6:
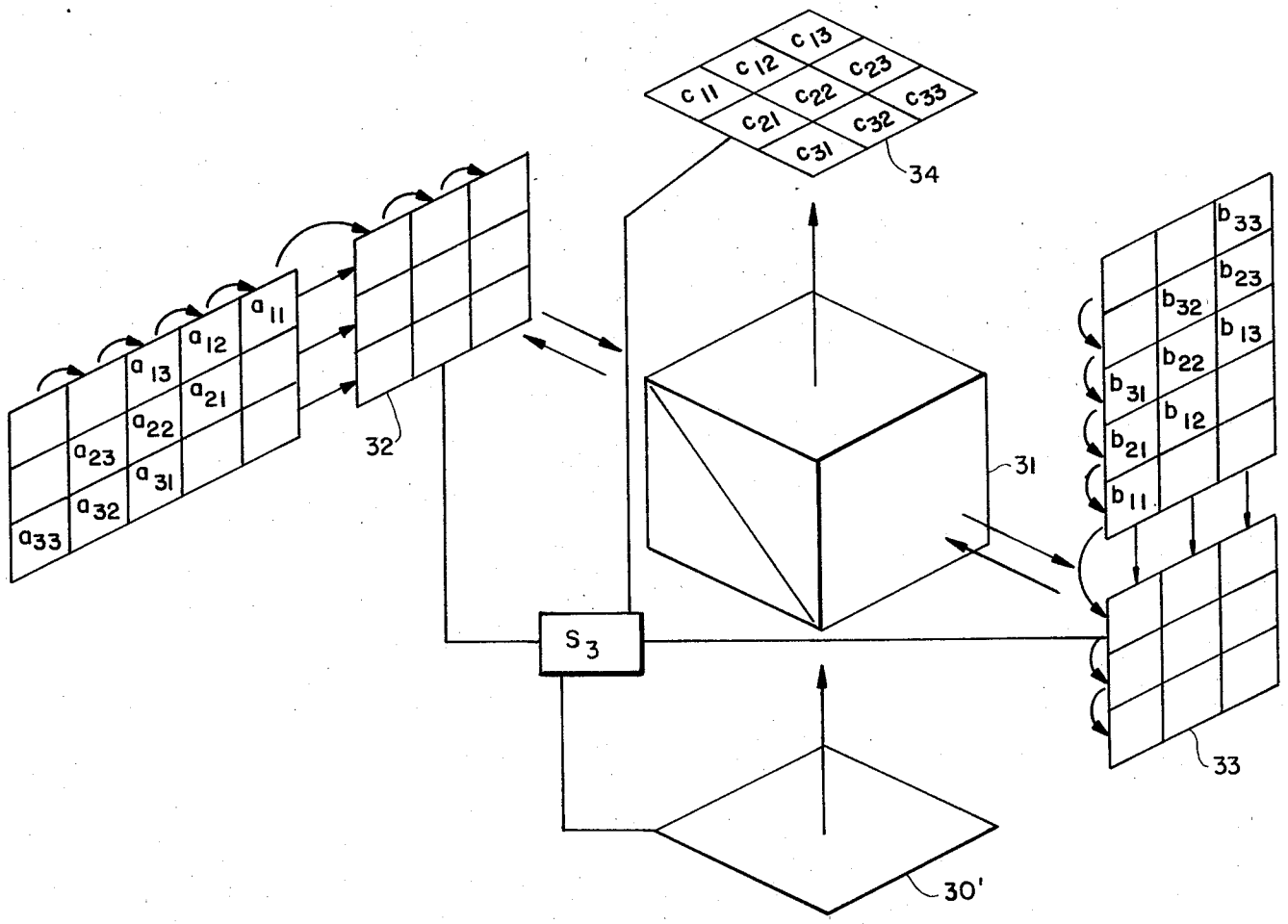
FIG. 6 presents a block diagram representation of data handling in the optical systolic array processor.

The matrix A and matrix B informations are clocked into the light valve as shown in FIG. 6. The switching of information in light valves, some typical designs to be later identified, is in accordance with switching operations well established in the art and further elaboration is unnecessary to apprise one skilled in the art to which the invention pertains. Again, the matrix C information is generated within photodetector array 34.

Figure 7:
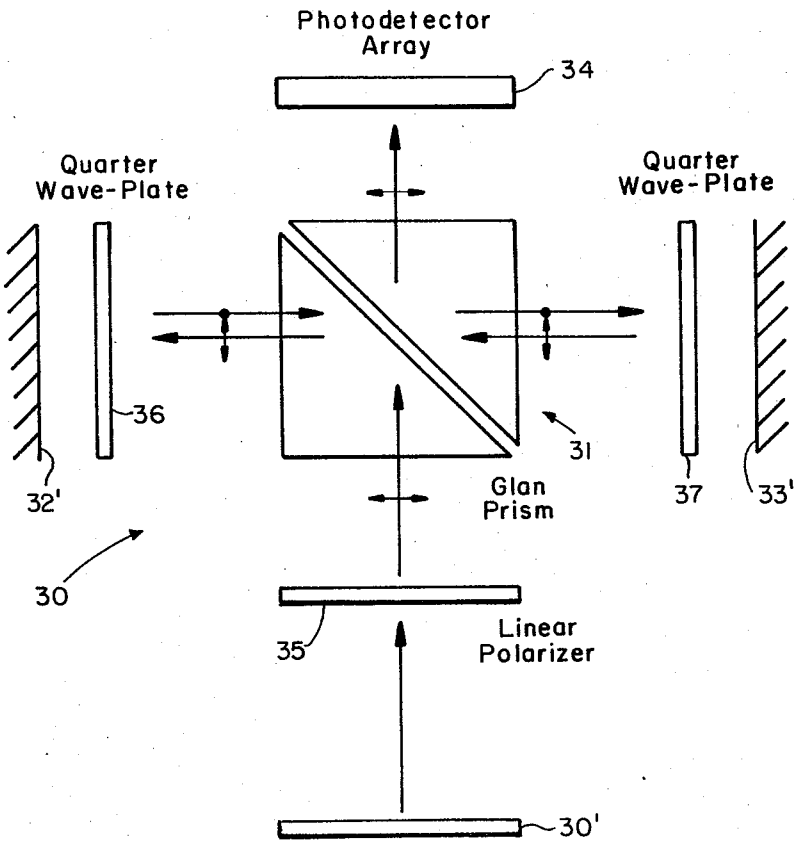
FIG. 7 shows a typical polarizing beamsplitter with its associated support optics.

The reason for using a polarizing beamsplitter in this architecture is to eliminate light from propagating directly from the light source to the photodetector array without first reflecting from each of the two light valves. If the light valves truly behave as reflecting mirrors, a modified type of polarizing beamsplitter arrangement may be preferable, see FIG. 7. A linear polarizer 35 would be interposed between the incoherent collimated light source 30' and polarizing beamsplitter 31. The beamsplitter would be of the Glan prism variety as fully described by G. R. Fowles in *Introduction to Modern Optics,* Holt, Reinhardt and Winston. 1968 on pages 182 et seq. In addition, two quarterwave plates 36 and 37 would be required to be interposed between the polarizing beamsplitter and their respectively associated reflective light valves 32' or 33'.

Any one of a number of light valves could potentially be used in the system architectures described. CCD address liquid crystal light valves manufactured by Hughes, Litton 2-D magnetooptic spatial light modulators, Texas Instruments deformable mirror modulator or the Motorola electronically addressed PLZT light modulator typify light valves freely available in the art which could be included for the designated light valves referred to above. Other possible light valve devices which optionally are employed are charge-coupled devices operating on the Franz-Keldish effect (see R. H. Kingston et al article entitled "Spatial Light Modulation Using Electroabsorption in a Galium Arsenide Charged-Coupled Device," *Applied Physics Letters,* vol. 41, pp. 413–415. 1982. Optionally a 2-D acoustooptic modulator with multiple channel inputs could be substituted. Light emitting diodes or laser diodes appear to be the most attractive candidates to choose from for the incoherent light source. Lastly, the photodetector array could be selected from any one of a number of commercially available photodiodes or photoactivated charged-coupled devices.

The architectures described hereinabove have assumed, for the sake of simplicity, that the elements of the matrices A and B and the product matrix C were real and positive only. The performance of matrix operations involving matrices and vectors whose elements are bipolar or even complex using incoherent light has previously been addressed in the references identified above. These techniques, therefore, should easily be extended to improve this architecture as well. The mathematical operation of the matrix-matrix multiplication is so fundamental to a number of higher-order matrix operations so that this basic architecture can serve as a modular building block for those higher-order operations.

Figure 8A:
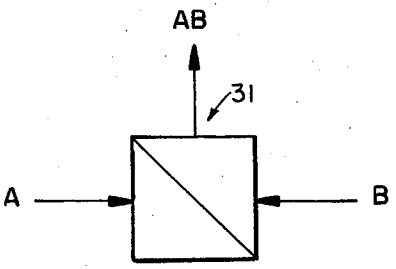
FIG. 8*a* sets forth the symbolic architecture for performing a basic matrix-matrix multiplication AB.

The basic matrix-matrix multiplying operation fabricated in accordance with the teachings of this inventive concept is symbolically represented by the diagram in FIG. 8*a*. Again matrix A and matrix B are the information input matrices and AB is the desired product output matrix.

Figure 8B:
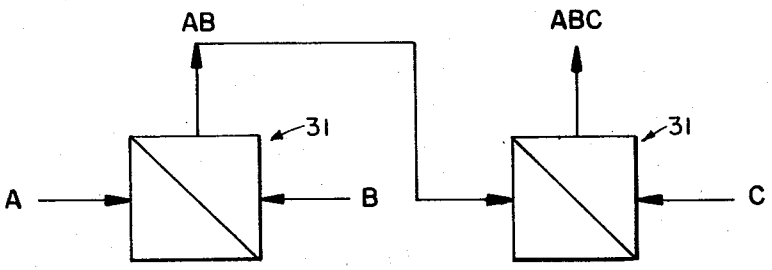
FIG. 8*b* depicts the architecture for performing the matrix operation ABC in which two cascaded polarizing beamsplitters are used.

If it were important to perform the multiplication of the three matrices, that is:

$$ABC = \begin{bmatrix} a_{11} & a_{12} & a_{13} \\ a_{21} & a_{22} & a_{23} \\ a_{31} & a_{32} & a_{33} \end{bmatrix} \begin{bmatrix} b_{11} & b_{12} & b_{13} \\ b_{21} & b_{22} & b_{23} \\ b_{31} & b_{32} & b_{33} \end{bmatrix} \begin{bmatrix} c_{11} & c_{12} & c_{13} \\ c_{21} & c_{22} & c_{23} \\ c_{31} & c_{32} & c_{33} \end{bmatrix}$$

then two processing tubes need only be connected in serial manner as depicted in FIG. 8*b* to perform the necessary ABC multiplication. The product of the three matrices would be useful for image processing-type applications. For example, such an arrangement would be useful for computing the 2-D discrete Fourier transform of an array of pictorial information. Matrix B could be preset to contain sampled values of the image while matrices A and C are preset to contain the discrete Fourier transform kernel information. As a consequence, the matrix ABC provides the desired discrete Fourier transform.

Figure 8C:
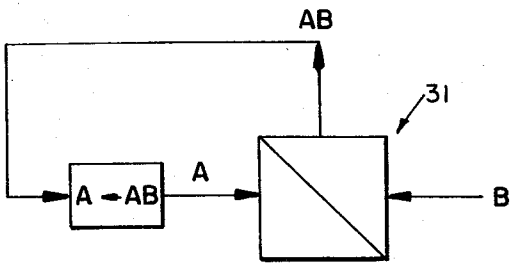
FIG. 8*c* shows yet another architecture for performing an iterative processing using feedback.

The architecture depicted in FIG. 8*c* finds application in those areas which, for example, use iterative processing requiring feedback. The expression A<AB as seen in FIG. 8*c* is interpreted as meaning that A is replaced by the matrix product of A and B.

From the foregoing disclosure it is apparent that the solution of simultaneous equations, matrix inversion, and Eigen system determination within the capability of the disclosed inventive concept calling for higher-order operations which can be performed using iterative processing. The matrix-matrix multiplication using an optical systolic array architecture is capable of real-time processing handling increased amounts of data when the orders of the matrices are brought within limits to encompass the vast amounts of data encountered.

Figure 9:
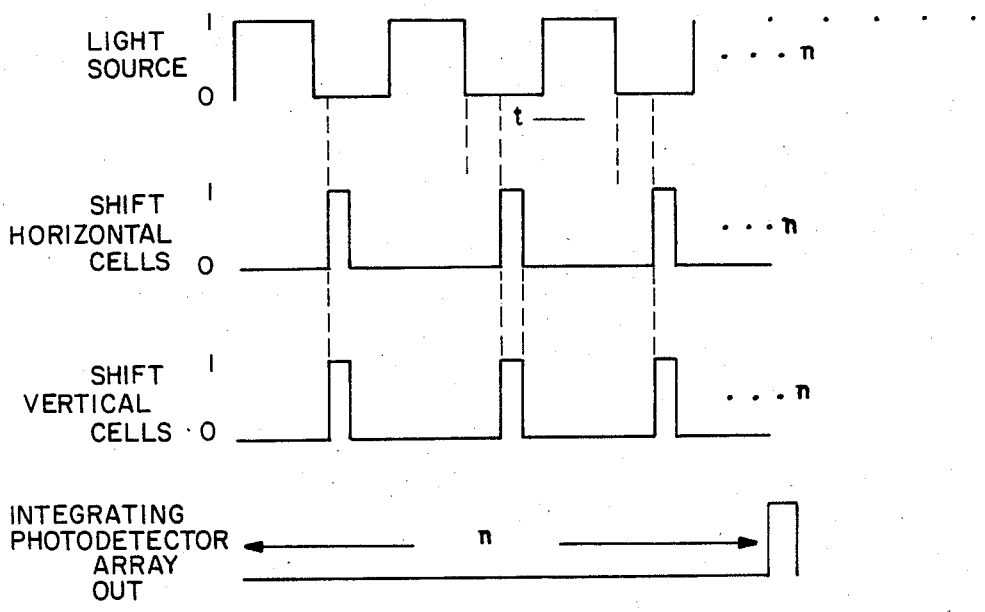
FIG. 9 depicts a rudimentary switching of the multiplier in accordance with this concept.

In operation, see FIG. 9, the collimated light source 11, 21 or 30' is pulsed in a sequence of pulses to project collimated incoherent light. This pulsed light goes through transparencies 12 and 13 or transmitting valves 22 and 23 or is reflected by reflecting valves 32 and 33 or 32' and 33' in accordance with the matrix A (horizontal) or matrix B (vertical) information transcribed in the resolution cells. The information is collected in the array 14, 24 or 33.

After each pulsed illumination, the matrix A and matrix B is shifted horizontally or vertically one cell as indicated by the shift horizontal cells' and shift vertical cells' pulses. The pulses are fed to either the mechanical structure that physically displaces the films or the light valves that are electronically displaced. The successive light source pulses illuminate subsequently aligned resolution cells containing matrix A and matrix B information until the n cells have been processed at which time a pulse to the array gathers the integrated information in serial or parallel form from the number of photodetectors of the array.

Optionally, the light source can be continuously on instead of pulsed. In this case, the detector elements accumulate terms proportional to those obtained in the pulsed case.

Obviously many modifications and variations of the present invention are possible in the light of the above teachings. It is therefore to be understood that within the scope of the appended claims the invention may be practiced otherwise than as specifically described.

What is claimed is:

1. An apparatus for optically performing matrix-matrix multiplication using incoherent light comprising:

means for providing a source of pulsed incoherent light;

means disposed to intercepting at least a portion of the pulsed light from the incoherent light source providing means for changing the optical properties of the pulsed light having a first element provided with a plurality of resolution cells arranged in a pattern of progressively staggered rows and aligned columns encoded once, nonrepetitively with a first matrix of information receiving the portion of the pulsed light and being laterally displaceable thereacross in a first direction and a second element provided with a plurality of resolution cells arranged in a pattern of progressively staggered rows and aligned columns endoded once, nonrepetitively with a second matrix of information and receiving the portion of pulsed light from the resolution cells of the first matrix of the first element and being displaceable thereacross in a second direction that is orthogonal to the first direction of the resolution cells of the first element, the portion of the pulsed light affected by the resolution cells of the first matrix and the resolution cells of the second matrix effects the multiplication thereof;

means disposed in an aligned relationship with the changing means for integrating the portion of the pulsed light that the resolution cells of the first element and the second element permit passage thereto, the integrating means has a two-dimensional area architecture sized to equal the area sum of the resolution cells of one of the elements; and means coupled to the first element and the second element for actuating a simultaneous, mutually orthogonal displacement of the first and second matrix information in synchronization with the pulsing of the pulsed incoherent light source providing means.

2. An apparatus according to claim 1 in which the pulsed incoherent light source providing means is a collimated light source and the integrating means is a two-dimensional fixed array of photodetectors.

3. An apparatus according to claim 2 in which the first element and the second elements are light valves having the transmission characteristics of their resolution cells changeable electronically.

4. An apparatus according to claim 3 in which the light valves of the first and second elements have their transmissivities electronically changeable and are arranged in-line with the collimated light source and the two-dimensional fixed array of photodetectors.

5. An apparatus according to claim 3 further including:

means disposed between the collimated light source and the optical property changing means for splitting the portion of the pulsed light to the light valve of first element and the light valve of the second element and redirecting the portion of the pulsed light from the first element and the second element to the two-dimensional fixed array of photodetectors.

6. An apparatus according to claim 5 in which the splitting and redirecting means is a polarizing beam splitter.

7. An apparatus according to claim 6 in which the first element and the second elements are light valves having the reflective characteristics of their resolution cells changeable electronically.

8. An apparatus according to claim 7 in which the light valves of the first and second elements are orthogonally disposed from the polarizing beam splitter to receive the portion of the pulsed light therefrom and to reflect the portion of the pulsed light back thereto and onto the two-dimensional fixed array of photodetectors.

9. An apparatus according to claim 1 further including:

feedback loop means for iteratively feeding back a matrix product to the first element.

10. A method of performing the matrix-matrix multiplication using incoherent light comprising:

pulsing a source of incoherent light;

changing the optical properties of a portion of the pulsed light by a first element provided with a plurality of resolution cells encoded once, nonrepetitively with a first matrix information, the first matrix information of the first element being arranged in a pattern of progressively staggered rows and aligned columns;

displacing the first element in a first direction;

further changing the optical properties of the same portion of pulsed light by a second element provided with a plurality of resolution cells encoded once, nonrepetitively with a second matrix information, the second matrix information of the second element being arranged in a pattern of progressively staggered rows and aligned columns, the steps of changing and further changing the optical properties effects the matrix-matrix multiplication;

displacing the second element across the first element in a second direction that is orthogonal to the first direction of the first element;

integrating the portion of the pulsed light that the resolution cells of the first element and the second element optically change by a two-dimensional area architecture sized to equal the area sum of the resolution cells of one of the elements; and actuating a mutually orthogonal simultaneous displacing of the first and second matrix information in synchronization with the pulsing of the incoherent light.

11. A method according to claim 10 in which the step of pulsing relies upon a pulsed collimated light source and the step of integrating relies upon a two-dimensional fixed array of photodetectors.

12. An apparatus according to claim 11 in which the first element and the second elements are light valves having the transmission characteristics of their resolution cells changeable electronically.

13. A method according to claim 12 in which the light valves of the first and second elements have their transmissivities electronically changeable and are arranged in-line with the collimated light source and the two-dimensional fixed array of photodetectors.

14. A method according to claim 12 further including:

splitting the portion of the pulsed light to the first element and the second element and redirecting the portion of the pulsed light from the first element and the second element to the two-dimensional fixed array of photodetectors.

15. A method according to claim 14 in which the step of splitting and redirecting relies upon a polarizing beam splitter.

16. A method according to claim 15 in which the first element and the second elements are light valves having the reflective characteristics of their resolution cells changeable electronically.

17. An apparatus according to claim 16 in which the light valves of the first and second elements are orthogonally disposed from the polarizing beam splitter to receive the portion of the pulsed light therefrom and to reflect the portion of the pulsed light back thereto and onto the two-dimensional fixed array of photodetectors.

18. An apparatus for performing matrix-matrix multiplication using incoherent light comprising:

means for providing a source of incoherent light;

first means disposed to intercept at least a portion of the light from the incoherent light source providing means for changing its optical properties having a first element provided with a plurality of resolution cells arranged in a pattern of progressively staggered rows and aligned columns encoded once, nonrepetitively with a first matrix information receiving the portion of the light and being laterally displaceable thereacross in a first direction and a second element provided with a plurality of resolution cells arranged in a pattern of progressively staggered rows and aligned columns encoded once, nonrepetitively with a second matrix information and receiving the portion of light and being displaceable thereacross in a second direction that is orthogonal to the first direction of the resolution cells of the first element;

second means disposed to intercept at least a portion of the light from the first changing means for changing its optical properties having a first element provided with a plurality of resolution cells arranged in a pattern of progressively staggered rows and aligned columns encoded once, nonrepetitively with a first matrix information receiving the portion of the light and being laterally displaceable thereacross in a first direction and receiving the portion of light; and means disposed in an aligned relationship with the second changing means for integrating the portion of the light that the resolution cells of the first element and the second element of the first changing means and the first element of the second changing means permit passage thereto, the integrating means has a two-dimensional area architecture sized to equal the sum of the resolution cells of one of the elements of the first changing means and the first element of the second changing means.

* * * * *